US006463256B2

(12) United States Patent
Blackman

(10) Patent No.: US 6,463,256 B2
(45) Date of Patent: Oct. 8, 2002

(54) DUPLEXING MODULE FOR PRINTER

(75) Inventor: Jeffrey R. Blackman, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/795,625

(22) Filed: Feb. 28, 2001

(65) Prior Publication Data

US 2001/0005463 A1 Jun. 28, 2001

Related U.S. Application Data

(63) Continuation-in-part of application No. 09/607,679, filed on Jun. 30, 2000, which is a continuation-in-part of application No. 09/283,107, filed on Mar. 31, 1999, now Pat. No. 6,167,231.

(51) Int. Cl.[7] ..... G03G 15/00

(52) U.S. Cl. ..... 399/401; 399/364

(58) Field of Search ..... 399/364, 381, 399/388, 397, 401, 45, 13; 271/3.05, 186, 225, 902; 400/636, 578; 347/104

(56) References Cited

U.S. PATENT DOCUMENTS 4,708,462 A * 11/1987 Stemmle ..... 271/186 X
5,022,640 A * 6/1991 Greco, Jr. ..... 271/3.05
5,430,536 A 7/1995 Fullerton et al. ..... 399/364
5,772,343 A 6/1998 Beretta et al. ..... 400/624
5,836,706 A 11/1998 Ruhe ..... 400/636
6,018,640 A 1/2000 Blackman et al. ..... 399/364
6,029,020 A * 2/2000 Blackman et al. ..... 399/364 X
6,042,109 A 3/2000 Klausbruckner ..... 271/225
6,118,950 A 9/2000 Wibbels et al. ..... 399/16
6,167,231 A 12/2000 Blackman et al. ..... 399/364

OTHER PUBLICATIONS

Hewlett–Packard Company U.S. patent application Ser. No. 09/607,679, filed Jun. 30, 2000, entitled "Modular Autoduplex Mechanism With Simple Linkage".

* cited by examiner

*Primary Examiner*—Sophia S. Chen
*Assistant Examiner*—Hoan Tran

(57) ABSTRACT

A duplexing module that is attachable to a printer that has a simplex media-handling system. The duplexing module is used in conjunction with the simplex system to carry out the print media handling (flipping) that is required for duplex printing. The module includes a single drive roller and an entry guide. The printer feed roller moves the printed media sheet along the entry guide to the drive roller of the duplexing module. The duplexing module includes an exit guide that extends between the drive roller and the feed roller. The print media (having one side printed) moves with the rotated drive roller until it reaches the exit guide. The printed side of the print media is thus directed against the feed roller of the printer so that the opposite side of the media is presented for printing.

19 Claims, 3 Drawing Sheets

DUPLEXING MODULE FOR PRINTER

This is a continuation-in-part of U.S. patent application Ser. No. 09/607,679, filed Jun. 30, 2000 which is a continuation-in-part of U.S. patent application Ser. No. 09/283,107, filed Mar. 31, 1999, now U.S. Pat. No. 6,167,231. Both of these applications are hereby incorporated by reference.

TECHNICAL FIELD

This invention relates to methods and apparatus for efficiently moving print media to enable printing on both sides of the media. Printing on both sides of the media is known as duplex printing.

BACKGROUND OF THE INVENTION

Duplex printing is a desirable feature in printing systems. The advantages of duplex printing include reducing the amount of paper required as compared to one-sided (simplex) printing, and generating print sets with layouts resembling that of professionally printed books. Conventional duplex printing devices employ complex media handling mechanisms. Typically, an extra tray is used for temporary storage of pages having printing on a first side. In an alternative approach, a second media path is provided to route a first printed page around the existing paper supply.

Similarly, duplex copying typically is accomplished by either one of two methods. In one method, first-side copies are stacked in a duplex tray. When a set of first-side copies is complete, the copies are fed out of the duplex tray and returned with an odd number of inversions along a duplex path to receive second-side imaging. In an alternative method, first-side copies are returned directly to receive second-side imaging without stacking.

Conventional duplexing devices tend to have long media paths and many parts. (Hereafter, the term "paper" and "media" will be used interchangeably with the understanding that although paper is a common type of print media, that term is intended to include any other type of media for receiving printed information thereon.) A substantial challenge with devices having these complex paper paths is preventing paper jams and otherwise ensuring that the paper moves smoothly from one guide or roller to the next.

Also, as the paper path becomes more convoluted, there is an increased need for ensuring that the paper does not become skewed as it moves through the path. Skewing means a slight shifting or rotation of the sheet about an axis normal to the surface of the sheet. If a sheet becomes skewed as it moves between first-side and second-side printing, the second-side printing will not be evenly applied to the sheet. Accordingly, it is important that the paper path associated with a duplexing module be designed to ensure that skew does not occur. Preferably, such a non-skew paper path will be inexpensive to design and manufacture and require very little maintenance.

Certain media, such a photographic media, may suffer it is thereafter bent through too small a radius of curvature. For example, such small-radius bending of the sheet may cause the printed sheet to curl, which is undesirable. Nonetheless, there is oftentimes a need for duplex printing on photographic media. For instance, it may be desirable to print identifying information on the back of a printed, photo quality image. It is thus important to minimize the bending of the media (hence, protect against curl) as the photographic media is moved through the path for such duplex printing.

SUMMARY OF THE INVENTION

The present invention is directed to a duplexing module that is attachable to a printer that has a simplex media-handling system. The duplexing module is used in conjunction with the simplex system to carry out the print media handling (flipping) that is required for duplex printing.

The module of the present invention is intended for use with a printer that has a feed roller that is rotatable for moving print media toward the print source for printing on one side of the media. The rotation of the feed roller is reversible for thereafter moving the printed media away from the print source and into the adjacent duplexing module.

The duplexing module flips the print media and returns it to the feed roller with the non-printed side exposed for printing. In the present invention, the module includes a drive roller and an entry guide. The entry guide extends between a portion of the drive roller surface and a location adjacent to the feed roller. When the duplexing module is attached to the printer, the printer feed roller is driven to move the printed media sheet along the entry guide from where the sheet passes to the drive roller of the duplexing module.

The duplexing module also includes an exit guide that extends between the drive roller surface and a location adjacent to the feed roller, very near the location where the entry guide joins the feed roller. The print media (having one side printed) moves with the rotated drive roller until it reaches the exit guide. The printed side of the print media is directed against the feed roller of the printer so that the opposite side of the media is now ready for printing.

The method and apparatus of the present invention provides a very simple paper path through the duplexing module. To this end, only a single drive roller is employed for moving the paper away from and back to the feed roller of the printer. Thus, the manufacturing cost and complexity of the module is greatly reduced as compared to more complicated mechanisms for advancing the print media through the duplexing module. For example, the use of a single drive roller minimizes the number of required components (drive shaft, roller "tires" etc.). Also, a single drive roller can be driven by the printer drive motor using a relatively simple drive connection.

Moreover, since the media is advanced through the duplexing module by a single roller, there is reduced likelihood of paper skew occurring. The media is substantially wrapped around the drive roller and rotates with the driver roller through about 270 degrees before being redirected from the drive roller back to the feed roller of the simplex printing system.

Another advantage of the use of a single drive roller in the duplexing module (as compared to the use of two or more drive rollers) is that there is reduced likelihood of the paper being stressed as it moves through the module. Specifically, in a system using two or more drive rollers the drive speeds of the rollers may not precisely match because of manufacturing tolerances (size of rollers, shafts, gears etc). Thus, if the second of a two-roller system is driven slightly faster than the first roller, the media will be pulled between the two rollers. The resultant tension in the media produces drag on the system that must be overcome with more torque applied to the roller. On the other hand, if the second of a two-roller system is driven slightly slower than the first roller, the media may become lose or even bunch up between the rollers.

The diameter of the drive roller of the duplexing module is selected to be relatively large. This reduces the radius that the print media is wrapped around. The use of a large-diameter roller reduces the torque that is required to move the media, especially relatively stiff media, such as card stock. Reduced torque increases the life of the drive motor. Thus, the use of a large diameter drive roller expands (for a given applied torque) the range of print media types (stiffness) that can be fed through the duplexing module.

Apparatus and methods for carrying out the invention are described in detail below. Other advantages and features of the present invention will become clear upon review of the following portions of this specification and the drawings.

DETAILED DESCRIPTION OF PREFERRED EMBODIMENTS

Overview

Figure 1:
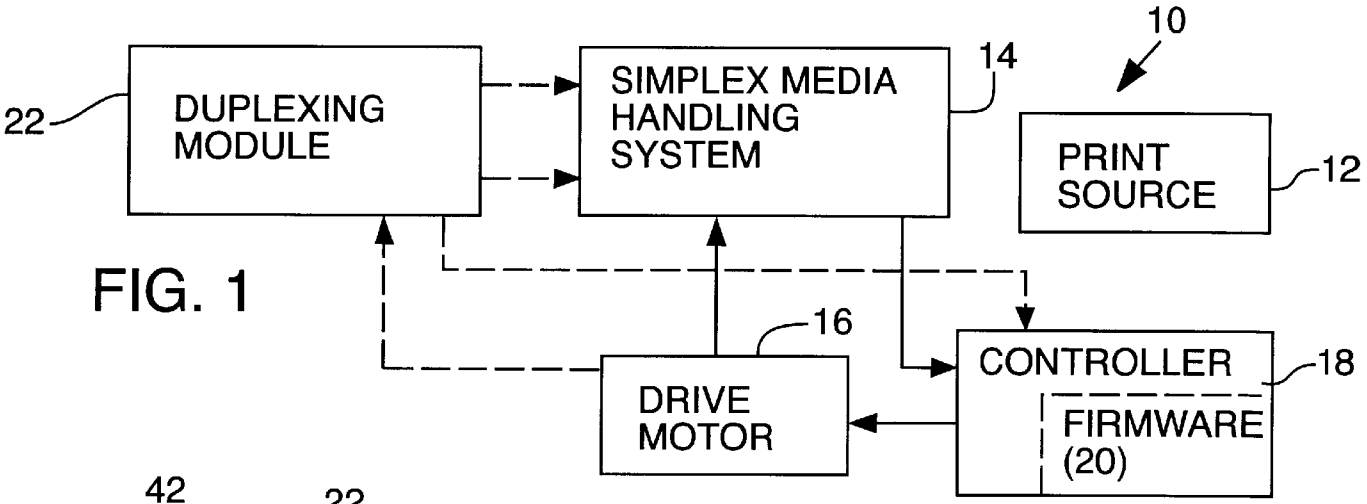
FIG. 1 is a block diagram of a duplexing module and print system according to one embodiment of this invention.

FIG. 1 illustrates in block diagram a printing system 10 that includes a print source 12, a simplex media handling system 14, a drive motor 16, and a controller 18 with firmware 20. Also included in the system 10 is a duplexing module 22. The duplexing module 22 is removable, allowing the system 10 to be customized for simplex printing and duplex printing.

Figure 2:
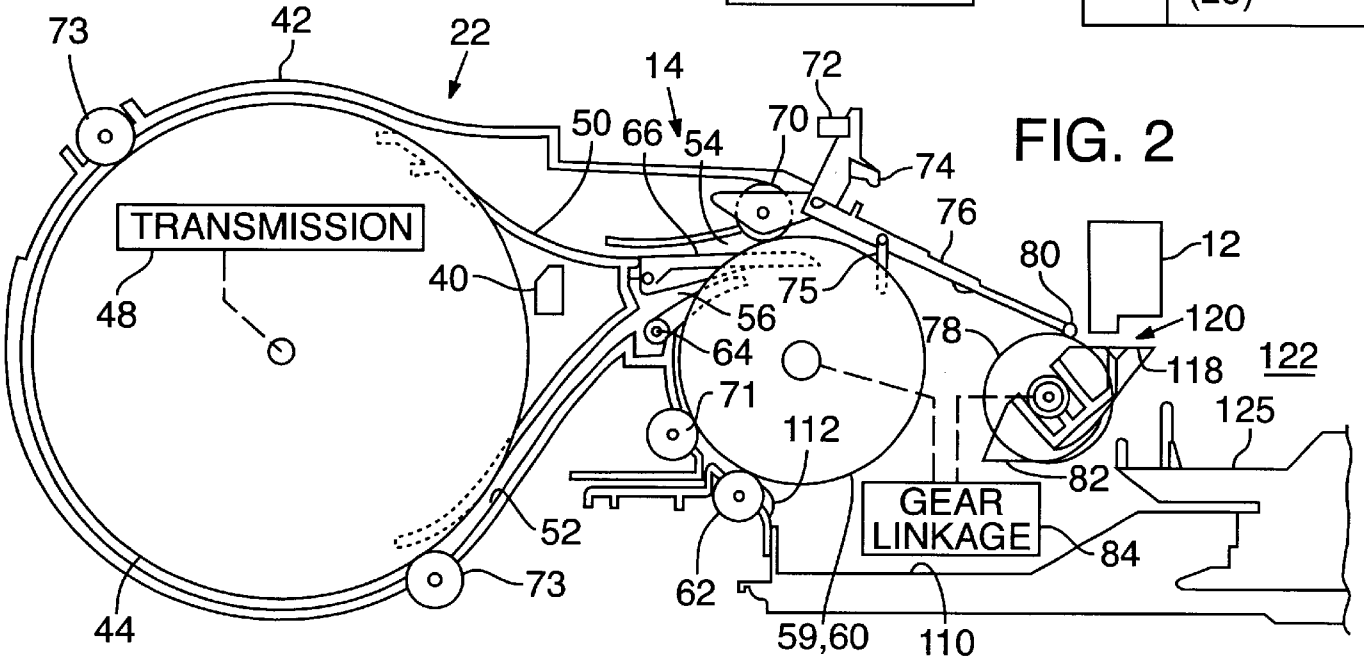
FIG. 2 is a side view diagram of a duplexing module and a simplex media handling system according to an embodiment of this invention.

Referring to FIG. 2, the print source 12, simplex media handling system 14, and duplexing module 22 are shown for an inkjet printer embodiment. It will be appreciated, however, that the printing system can by any of a variety of devices for recording information on one side of media. The printing system can be, for example, a fax machine or laser-type printer or copier. Hereafter, however, the preferred embodiment is described in the context of an inkjet printing system.

The simplex media handling system 14 includes pick roller 59, feed rollers 60, feed idlers 62, a media sensor 72, flag 74, secondary flag 75, an upper guide 76, and metering rollers 78 with another set of pinch rollers 80, a pivot mechanism 82 and gear linkage 84. The drive motor 16 (see FIG. 1) is coupled to the feed rollers 60 and metering rollers 78 through the gear linkage 84. An opening is included for receiving the duplexing module 22.

The duplexing module 22 is removably attached to the simplex media handling system 14. The duplexing module includes a sensor 40 that interfaces with the controller 18, allowing the controller 18 to detect whether the duplexing module 22 is attached. An electrical, electromechanical, and/or electro-optical connection is included to direct the sensor 40 output to the printer controller 18. The controller 18 tests to determine whether the duplexing module 22 is installed. Specifically, if a sensor 40 signal is present, then the module 22 is installed (since the sensor is part of the module 22). The controller firmware 20 enables both simplex printing and duplex printing operations whenever the module 22 is attached. If a sensor 40 signal is not present, then the controller firmware 20 disables duplex printing operations and allows only simplex printing operations.

The printing system 10 receives a media sheet upon which text, graphics or other symbols are to be printed. For example, in this inkjet printer embodiment the printer receives a print job from a host computer (not shown). The controller 18 controls the printer drive motor 16 and the print source 12 (such as a conventional inkjet print cartridge) for coordinating the movement of the media sheet relative to the print source 12.

For single-sided (i.e., simplex) printing, the media sheet is fed through the simplex media handling system 14 adjacent to the print source 12 where the text, graphics, or other symbols are recorded on the media sheet. The sheet is then directed to an output tray 125.

For duplex printing, the media sheet is fed through the simplex media handling system 14 along the same media path used for simplex printing until the first side of the media sheet is completely printed. The media sheet then is fed back along a portion of that media path into the duplexing module 22. That module flips the media sheet, and then returns the media sheet to the simplex media handling system 14 for second-side printing.

The duplexing module 22 includes the sensor 40, a frame 42, a drive roller 44, a transmission 48, flip guides 64, 66, and pinch rollers 70, 71, 73. The transmission 48 is coupled to the drive motor 16 of the printing system, as described more below.

During duplex printing and after one side of the media sheet has been printed, the sheet is fed into the duplexing module 22. To this end the simplex media handling system 14 directs the sheet to slide along an entry guide 50 inside the frame 42 toward the drive roller 44. The guide 50 terminates at a location adjacent the surface of the drive roller 44 so that the media sheet moves into tangential contact with the roller 44 to move with the roller, secured thereto by pinch rollers 73.

The media sheet rotates with the drive roller 44 of the duplexing module until the sheet exits the roller 44 onto an exit guide 52 that directs the sheet back onto the feed rollers 60 of the simplex media handling system 14. Between the time the media sheet leaves and returns to the feed rollers 60 of the simplex media handling system, the rotational direction of the feed rollers 60 is reversed.

The duplexing module media path is essentially a circular loop around the circumference of the drive roller 44, having an entry location 54 in the vicinity of the exit location 56. Both the entry location 54 and the exit location 56 are adjacent to a common area of the simplex media handling system 14. As the media sheet is directed by the exit guide 52 into engagement with the feed rollers 60, the non-printed side of that sheet is exposed to the print source 12 for second-side printing and discharge into the output tray 125.

Figure 3:
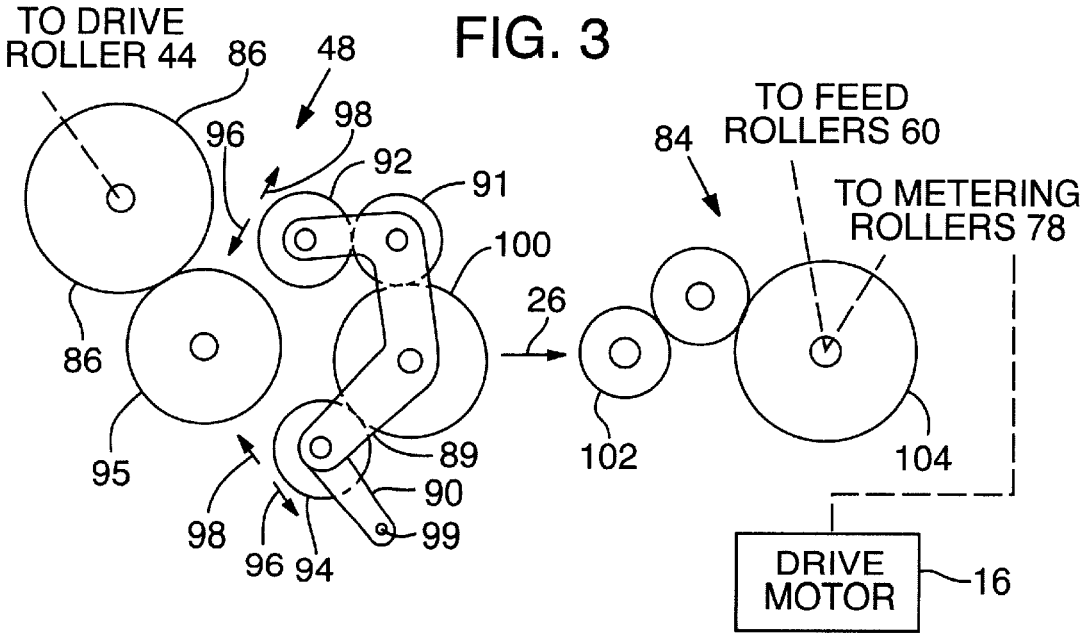
FIG. 3 is diagram of a transmission and gear linkage for connecting the simplex media handling system to the duplexing module, thereby to drive the latter.

Referring to FIG. 3, the gear linkage 84 of the simplex media handling system 14 is coupled to the transmission 48 of the duplexing module. The transmission 48 and gear linkage 84 couple the drive roller 44 to the printer drive motor 16. Specifically, when the duplexing module 22 is installed, coupling gear 100 is moved (in the direction shown by arrow 26, FIG. 3) into engagement with the gear linkage 84 of the simplex media handling system 14 at an interface gear 102. Gear linkage 84 also includes a drive gear 104, which is coupled to the drive motor 16 through a linkage included to drive the feed rollers 60 and metering rollers 78. Thus, it will be appreciated that the drive motor of the printing system is the motive power for the duplexing module.

The transmission 48 includes a drive gear 86 for engaging the shaft of the drive roller 44. Through a subset of gears 86, 91, 92, 94, 95, and 100, the transmission 48 engages the drive roller 44. As mentioned above, gear 100 serves as a coupling gear that links the transmission 48 to the gear linkage 84 of the simplex media handling system (e.g., at gear 102). Coupling gear 100 is driven by the printer drive motor 16 through the gear linkage 84. Transmission gears 91, 92, and 94 are coupled to gear 100, and are mounted to a gear mount 89.

The rotation of gear 100 (counterclockwise in FIG. 3) causes the mount 89 with gears 91, 92 and 94 to rotate about the gear 100 in one direction 96 (that is, one of two opposing directions 96, 98). Movement of the gears 91, 92, 94 in direction 96 brings gear 92 into engagement with gear 95, and gear 94 out of engagement with gear 95. Since gear 95 is permanently meshed with drive gear 86, this causes drive gear 86 to rotate in a counterclockwise direction. In this engagement of gears 92 and 95, the transmission 48 is considered to be in first gear.

The opposite, clockwise rotation of gear 100 (caused by the drive motor through gear linkage 84) results in movement of the gear mount 89 and gears 91, 92, 94 in direction 98, which brings gear 94 into engagement with gear 95, and gear 92 out of engagement with gear 95, thereby causing drive gear 86 to rotate in the same direction (counterclockwise) as before, even though the coupling gear 100 is rotating in the opposite direction. In this engagement of gears 94 and 95, the transmission 48 is considered to be in second gear.

In first gear, the feed rollers 60 and metering rollers 78 of the simplex media handling system are rotating in the same (counterclockwise) direction as the drive roller 44 of the duplexing module 22. Thus, first gear is employed when the media sheet is to be directed from the simplex media handling system to the duplexing module.

In second gear, the feed rollers 60 and metering rollers 78 of the simplex media handling system are rotating (clockwise) in the opposite direction as the drive roller 44 of the duplexing module 22. Thus, second gear is employed when the media sheet is to be directed from the duplexing module back to the simplex media handling system.

One preferred embodiment the transmission 48 also includes an optional clutch 90, which is coupled at one end of the gear mount 89. The other end of the clutch 90 includes a protrusion 99 that moves within a cam track (not shown). When the transmission 48 is in neutral, the protrusion 99 sits in a fixed location (e.g., a V-lock groove) of the cam track. It takes a change of direction of gear 100 to move the protrusion out of the V-lock. A gear change (one of gears 92, 94 engaging gear 95) may then occur. The clutch 90 moves with gear 94 in the directions 96, 98. When gear 92 is engaged or gear 94 is engaged, the protrusion 99 does not come to rest in the V-lock. It is when the transmission 48 is in neutral that the protrusion 99 sits in the V-lock.

To switch gears from engagement of gear 94 with gear 95 to neutral (the position illustrated in FIG. 3), the drive motor 16 stops driving gear 100, then restarts driving gear 100 in the opposite direction. This moves the gear 94 in direction 96 and brings the clutch 90 to rest in neutral (protrusion 99 sits in the V-lock). This is referred to as a stop and start action. To continue switching gears to bring gear 92 into engagement with gear 95, the direction of gear 100 is changed again to allow the clutch 90 to come out of neutral, then the direction is changed one more time to move the gears 92, 94 and clutch 90 further along in direction 96. This brings gear 92 into engagement with gear 95. The actions to switch from neutral to engagement of gear 92 (or gear 94) with gear 95 is called a jogging action. Neutral gear is desirable when, for example, the duplexing module 22 is attached to the print system 10 but no duplex printing is to occur. Thus the drive motor energy may be conserved (or used for other purposes) rather than for rotating the duplexing drive roller 44 as would occur if the transmission were otherwise engaged.

In a preferred embodiment the feed rollers 60 and metering rollers 78 are always driven in a common direction during simplex or duplex media handling. That common direction changes during duplex printing. Irrespective of the position of gears 92, 94, the drive roller 44 of the duplexing module rotates in the same direction (counterclockwise in this illustration) even though the feed rollers 60 and coupled metering rollers 78 change direction.

The specific gear linkages for the transmission 48 and linkage 84 may vary depending on the specific embodiment. For example the relative positioning and size of the simplex media handling system 14 and duplexing module 22 may vary, resulting in differing transmission 48 and linkage 84 embodiments.

Operation

The media handling operations for simplex and duplex printing are described with reference to FIGS. 4–7. For either simplex or duplex printing, a media sheet M is lifted into contact with a pick roller 59, which is coaxial with the feed rollers 60. The top sheet M is picked from a stack of media sheets that is held in an input tray 110. Excess media sheets are separated from the top sheet by contact with restraint pad system 112 (see FIG. 2).

Figure 4:
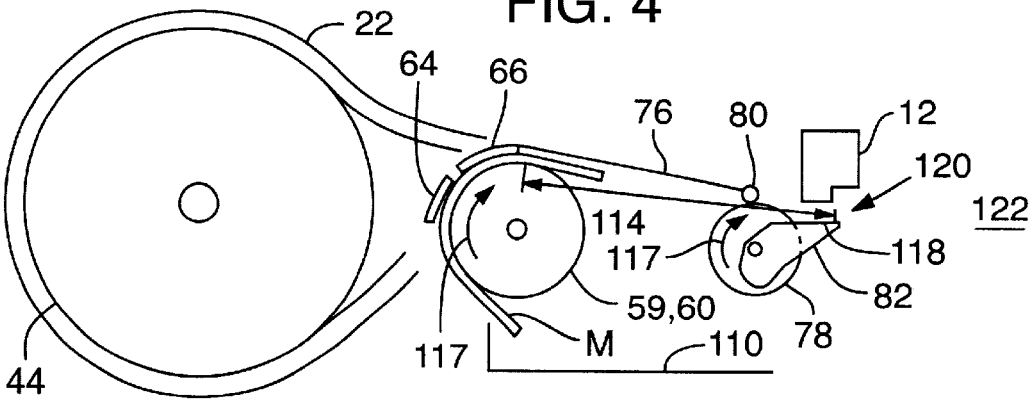
FIG. 4 is a simplified diagram primarily illustrating operation of the simplex media handing system for printing the first side of a media sheet.

The picked media sheet M is fed around feed rollers 60 (FIG. 4). The feed idlers 62 and pinch rollers 70, 71 (FIG. 2) press the media sheet to the feed rollers 60. The leading edge of the media sheet M pushes the flip guides 64, 66 out of the media path as the media sheet moves along the feed rollers 60. Beyond the flip guides 64, 66 the media sheet moves along a first media path 114. The media path 114 spans a path from pinch rollers 70 to the metering rollers 78 and into a print zone 120 that is adjacent to the print source 12.

The media sheet is moved between the feed rollers 60 and the pinch rollers 70 under the upper guide 76 and onto the metering rollers 78. Pinch rollers 80 press the media sheet to the metering rollers 78. Both the metering rollers 78 and the feed rollers 60 are moving in a forward direction 117 during the first-side printing operation (FIG. 4).

Eventually, a trailing edge of the media sheet M passes beyond the feed rollers 60 so that the metering rollers 78 alone move the media sheet. Beyond the pinch rollers 80, the media sheet is moved along a platform 118 of the pivot mechanism 82. The print source 12 is located adjacent to the platform 118. The media sheet M is fed through the print zone 120, which is between the platform 118 and the print source 12, and into an output region 122, which in some embodiments includes an output tray 125.

For simplex printing, the media sheet is released into the output region 122. Thereafter another media sheet may be picked and fed along the media path through the print zone for printing. This may be done immediately, or after a suitable drying time (depending on the type of print source).

During duplex printing, the trailing edge 124 of the media sheet M (FIG. 5) is not released after the first-side printing. While the pinch roller 80 presses the trailing edge 124 of the media sheet M to the metering roller 78, the motion of the feed rollers 60 and metering rollers 78 ceases. A suitable drying time is allowed before the drive motor 16 reverses the rotational direction of the feed rollers 60 and metering rollers 78 to a direction 121 (see FIG. 6).

The sensor 40, which, as explained above, also serves to indicate whether the duplexing module is installed, may also be (in an embodiment such as inkjet printing) a humidity sensor. The sensor 40 detects the ambient humidity. Printer controller 18, in response to the detected humidity, determines a sufficient drying time before allowing the media sheet to be moved for second-side printing. In alternative embodiments, separate sensors are used to determine humidity and whether the duplexing module is installed.

Figure 5:
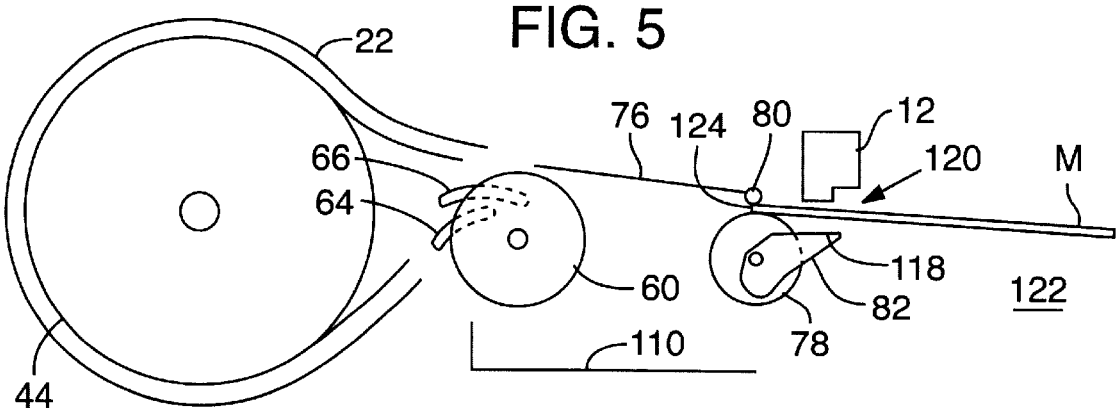
FIG. 5 is a diagram illustrating the simplex media handing system at the completion of first-side printing.

The determination of when to stop the metering rollers 78 with the media sheet trailing edge 124 grasped is now described with reference to FIGS. 2 and 5. The simplex media handling system 14 includes a media sensor 72 and flag 74 (FIG. 2). When the media sheet M is moved along the first media path 114 from the feed rollers 60 toward the metering rollers 78, the leading edge of the media sheet trips the flag 74. Once the trailing edge 124 passes beyond the flag, the flag 74 returns to its unbiased position. The sensor 72 monitors the media/flag motion and provides an output signal indicative of when the leading edge and trailing edge of the media sheet M have passed the flag 74. These indications are detected by the controller 18, which then determines when the trailing edge 124 of the media sheet M is at the pinch roller 80. At such time, the controller 18 has the drive motor 16 discontinue rotation of the feed rollers 60 and metering rollers 78. After a programmed pause (e.g., to allow for first-side drying), the controller 18 signals to the drive motor 16 to reverse the rotational directions of the feed rollers 60 and metering rollers 78 to the reverse direction 121.

Figure 6:
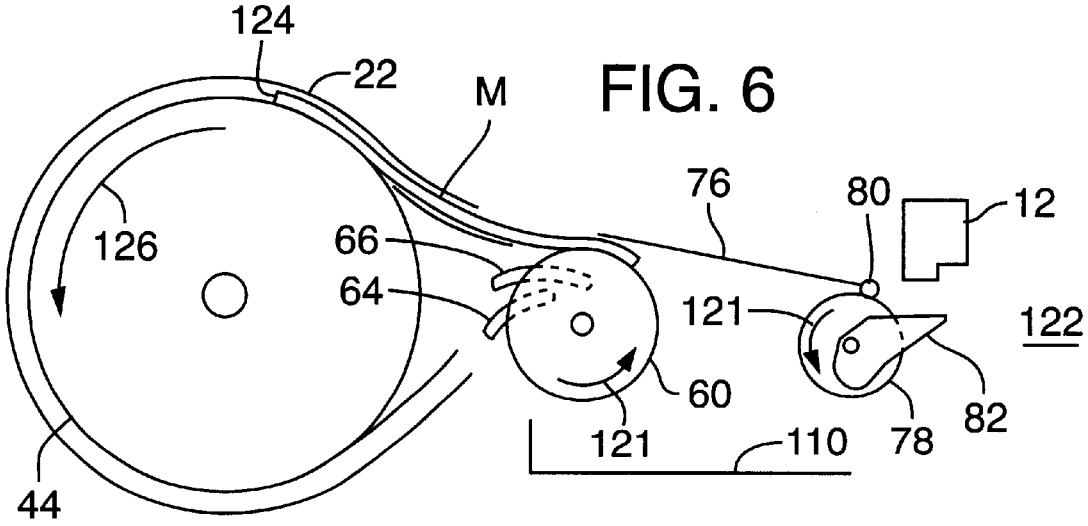
FIG. 6 is a diagram illustrating transfer of the one-side-printed sheet of media to the drive roller of the duplexing module.

Referring to FIG. 6, the metering rollers 78 feed the media sheet M back along the first media path 114 into contact with the feed rollers 60. The feed rollers 60 then continue feeding the media sheet away from the print source 12. Eventually the media sheet M is out of the grasp of the metering rollers 78 and thus moved only by the feed rollers 60 (as distinguished from both the feed rollers 60 and metering rollers 78).

The trailing edge 124 of the media sheet M contacts the upper surface of the entry flip guide 66, which is positioned in its unbiased position (FIGS. 2 and 6), thereby to block the media from returning to the input tray 110 and, instead, redirect the media sheet M over the flip guide 66 and adjacent entry guide 50 so that the media sheet passes into the entry 54 of the duplexing module 22. The feed rollers 60 thus feed the media sheet M onto the drive roller 44.

As the drive motor 16 reverses the directions of feed rollers 60 and metering rollers 78 to direction 121 (FIG. 6), the transmission 48 moves to second gear (i.e., gear 94 engages gear 95, see FIG. 3). As a result, when the media sheet is fed from the feed rollers 60 to the drive roller 44, the drive roller 44 is rotating in a direction 126 (counterclockwise in FIG. 6).

In a preferred embodiment, the duplexing module 22 has a media path length from entry location 54 to exit location 56 (FIG. 2) that is at least as long as the maximum rated media sheet length for automatic duplex handling (e.g., 17 inches). The diameter of the drive roller 44 is selected to be substantially large (for example, 4 inches or more) so that the media sheet M is not bent through too small a radius as it moves through the paper path of the duplexing module. Also, as mentioned above, the use of a large-diameter drive roller 44 reduces the torque that is required to move the media sheet, especially relatively stiff media, such as card stock. That is, for a given stiffness of media, there is a relatively reduced amount of force required for bending the media around a relatively increased radius of curvature, thereby to secure the media to the roller. This reduced force thus reduces the torque required to rotate the roller and media. Reduced torque increases the life (as well as reducing the power requirements) of the drive motor 16. Put another way, the use of a large diameter drive roller 44 expands (for a given applied torque) the range of print media types (stiffness) that can be fed through the duplexing module 22.

Moreover, it will be appreciated that since the media sheet is carried by a single roller 44 through the duplexing module 22, there is reduced likelihood for skewing of the sheet to occur, as discussed above. As noted above, the reduction in the number of drive rollers to a single drive roller 44 in the preferred embodiment of the duplexing module 22 reduces the likelihood of the paper being stressed as might otherwise occur in a system using two or more drive rollers having drive speeds that are not precisely matched because of manufacturing tolerances (size of rollers, shafts, gears etc). In short, the paper path in the duplexing module is essentially a simple, circular one conforming to about 270 degrees of the periphery of the drive roller 44.

Prior to the time the media sheet is fed out of the duplexing module 22 back onto the feed rollers 60, the feed rollers 60 are driven to change rotational direction from reverse direction 121 back to the forward direction 117. However, owing to the effects of the transmission 48 as explained above, the rotational direction of the drive roller 44 in the duplexing module remains the same (i.e., direction 126), even after the feed rollers 60 go back to the forward rotational direction 117.

The timing for changing directions of the feed rollers 60 back to the forward direction 117, while the media sheet is in the duplexing module 22, is now described. As the media sheet M is fed back along the first media path 114 from the metering rollers 78 to the feed rollers 60 (FIG. 6), the media sheet trips the secondary flag 75 which trips the flag 74 (see FIG. 2). The flag 74 once tripped, is then released after the entire media sheet passes beyond the flags 74, 75. The sensor 72 provides to the controller 18 an output signal representing such tripping indications. The controller knows what direction the drive motor 16 is rotating the rollers 60, 78, and thus knows that the media sheet is being fed back for duplex printing.

Thus, once the media sheet M has passed completely beyond the flag 74, the controller 18 waits a prescribed time (based upon path length and feed speed) until the media sheet is off the feed rollers 60 and pinch rollers 70 and is moved solely by the rotation of the drive roller 44. In particular, the controller 18 waits until the media sheet is a prescribed distance beyond the feed roller and completely located within the duplexing module 22. At such time, the controller 18 signals the drive motor 16 to change the rotational direction of the feed rollers 60 and metering rollers 78 back to the original forward direction 117.

Figure 7:
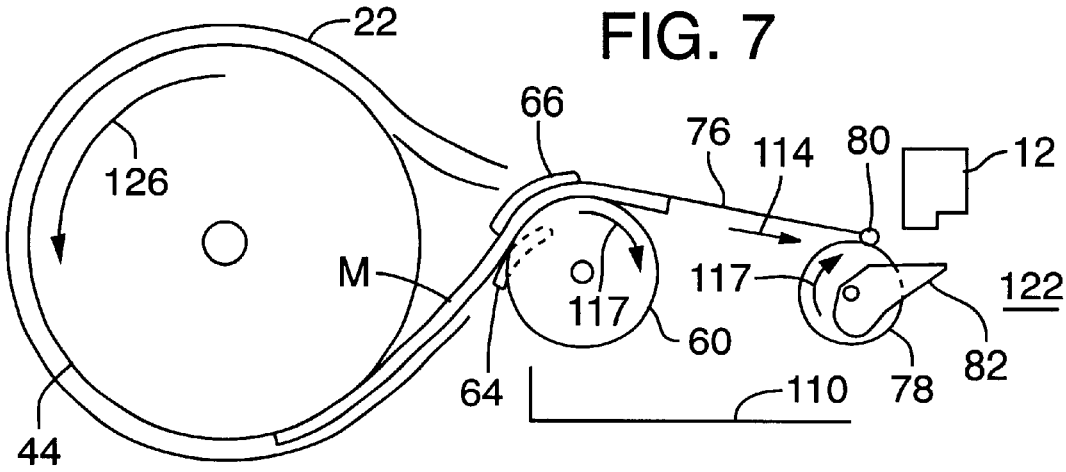
FIG. 7 is a diagram illustrating the one-side-printed sheet of print media being redirected to the feed roller of the simplex media handling system in a manner that exposes the non-printed side of the media for printing thereby to complete the duplex printing operation.

FIG. 7 shows the media sheet M emerging from the duplexing module 22 with the feed rollers 60 of the simplex media handling system restarted in the forward direction 117. This stopping and starting action of the feed rollers 60 (and metering rollers 78) moves the clutch 90 (see FIG. 3) causing the second gear 94 to disengage. Specifically, the stopping and starting action puts the transmission 48 into neutral. To shift the transmission 48 out of neutral, and more particularly to engage the first gear 92, rather than the second gear 94, a jogging action is performed as described above. With the first gear 92 engaged while the feed rollers 60 rotate in the forward direction, the drive roller 44 rotates in the desired direction 126 (see FIG. 7).

With the feed rollers 60 and metering rollers 78 rotating in direction 117 while the drive roller 44 continues to rotate in direction 126, the media sheet M is fed out of the duplexing module 22 back onto the feed rollers 60. As a leading edge of the media sheet exits the duplexing module 22 it moves the flip guide 66 out of its path allowing the media sheet to be grasped by the feed rollers 60 and pinch rollers 70 and moved back onto the first media path 114 (see FIG. 7). The media sheet M goes over the flip guide 64 and under the flip guide 66. The media sheet M is fed along the first media path 114 under the upper guide 76 for leading-edge sensing via sensor 72 and flags 74, 75, and onto the metering rollers 78 and the platform 118, into the print zone 120 for second-side printing. The media sheet M is fed through the print zone 120 into the output region 122. The media sheet then is released into the output tray 125.

Having here described preferred embodiments of the present invention, it is anticipated that individuals skilled in the art may make other modifications thereto within the scope of the invention. The spirit and scope of the invention is not limited to those embodiments, but extend to the various modifications and equivalents of the invention defined in the appended claims.

What is claimed is:

1. A duplexing module attachable to a printing device that has a feed roller that moves a sheet of print media to and from a print source, comprising:

an entry guide located adjacent to the feed roller when the duplexing module is attached to the printing device thereby to receive the sheet of print media from the feed roller;

an exit guide located adjacent to the feed roller when the duplexing module is attached to the printing device to direct the sheet from the duplexing module to the feed roller; and a drive roller mounted to have surface portions adjacent to the entry and exit guides and configured for moving the sheet from the entry guide to the exit guide.

2. The module of claim 1 further comprising a path along which the sheet moves in e duplexing module between the entry and exit guides, the path being substantially circular.

3. The module of claim 2 wherein the drive roller is arranged so that the sheet moves from the entry guide to the drive roller and from the drive roller to the exit guide such that between the entry and exit guides the pat of the sheet in the duplexing module substantially corresponds to the circumference of the drive roller.

4. The module of claim 3 wherein the path is circular for about 270 degrees.

5. The module of claim 1 wherein the drive roller has a diameter that is substantially greater than the diameter of the feed roller.

6. The module of claim 1 further comprising gear linkage for connecting a reversible drive motor in the printing device to the drive roller of the duplexing module so that the drive motor drives both the feed roller and the drive roller.

7. The module of claim 6 including a transmission connected between the drive motor and the drive roller for driving the drive roller in a one direction as the feed roller is driven in either of two opposing directions.

8. A method of making a duplexing module for a printing device that has a feed roller for moving a sheet of print media, the method comprising the steps of:

providing an entry guide along which may be slid a sheet of print media away from the feed roller;

providing an exit guide along which may be slid a sheet of print media toward the feed roller; and mounting a single rotatable duplexing roller so that the entry guide and the exit guide are both substantially tangent to the periphery of the duplexing roller such that a sheet of print media will slide from the entry guide, onto the rotating duplexing roller and from the duplexing roller onto the exit guide.

9. The method of claim 8 including the step of arranging the duplexing roller so that the sheet of print media that is slid onto the duplexing roller will be rotated by the duplexing roller through about 270 degrees.

10. The method of claim 8 including the step of sizing the duplexing roller to have a radius of about 2 inches.

11. A method of flipping a sheet of print media to enable printing on both sides of that sheet, comprising the steps of:

directing a sheet of it media from a feed roller to a print source with a first side of the media exposed to receive printing thereon;

moving the sheet from the feed roller onto a drive roller;

rotating the drive roller with the sheet thereon;

redirecting the sheet from the drive roller back to the feed roller with a second side of the sheet exposed for printing thereon.

12. The method of claim 11 including the steps of providing an entry guide between the feed roller and the drive roller and sliding the sheet along the entry guide from the feed roller to the drive roller.

13. The method of claim 12 including the steps of providing an exit guide between the drive roller and the feed roller and sliding the sheet along the exit guide from the drive roller to the feed roller.

14. The method of claim 11 wherein the directing step includes rotating the feed roller in a first direction and the redirecting step includes rotating the feed roller in a direction that is opposite the first direction.

15. The method of claim 11 including the step of sizing the drive roller to have a diameter that is greater than the diameter of the feed roller thereby to enable the use of a single drive roller for flipping the sheet.

16. The method of claim 11 wherein the rotating step includes rotating the sheet on the drive roller through about 270 degrees so that upon moving from the drive roller the sheet is redirected to a location on the feed roller near a location where the sheet moves from the feed roller during the step of moving the sheet from the feed roller onto the drive roller.

17. The method of claim 11 wherein the rotating step is carried out with a single drive roller.

18. The method of claim 14 wherein the drive roller is rotated in only a single direction.

19. The method of claim 11 wherein the rotating step comprises rotating the drive roller in a single direction irrespective of the rotation direction of the feed roller.

* * * * *

UNITED STATES PATENT AND TRADEMARK OFFICE

CERTIFICATE OF CORRECTION

PATENT NO. : 6,463,256 B2
DATED : October 8, 2002
INVENTOR(S) : Jeffrey R. Blackman It is certified that error appears in the above-identified patent and that said Letters Patent is hereby corrected as shown below:

Column 9,
Line 51, “in e duplexing” should read -- in the duplexing --;
Line 55, “the pat of the” should read -- the path of the --.

Signed and Sealed this

Thirteenth Day of July, 2004

JON W. DUDAS
*Acting Director of the United States Patent and Trademark Office*